US006062356A

United States Patent [19]

Nykoluk

[11] Patent Number: 6,062,356

[45] Date of Patent: May 16, 2000

[54] BAG WITH INTEGRATED EDGE GUARD AND FOOT

[75] Inventor: Cory O. Nykoluk, San Jose, Calif.

[73] Assignee: Mainland Marketing, Inc., Half Moon Bay, Calif.

[21] Appl. No.: 09/066,079

[22] Filed: Apr. 24, 1998

[51] Int. Cl.[7] ..... A45C 5/00; A45C 13/36

[52] U.S. Cl. ..... 190/18 R; 190/37; 190/903

[58] Field of Search ..... 190/37, 18 R, 190/18 A, 903

[56] References Cited

U.S. PATENT DOCUMENTS

| | | | |
|---|---|---|---|
| 2,114,683 | 4/1938 | Kates | 190/18 R X |
| 2,493,580 | 1/1950 | Heilmann | 190/37 X |
| 2,779,371 | 1/1957 | Klehr | 190/18 R |
| 2,895,574 | 7/1959 | Koffler | 190/37 |
| 4,160,495 | 7/1979 | Conrad | 190/18 A |
| 4,397,378 | 8/1983 | Lee | 190/903 X |
| 4,669,587 | 6/1987 | Zitt | 190/37 X |
| 4,993,526 | 2/1991 | Morrison | 190/37 X |
| 5,115,895 | 5/1992 | Myers | 190/18 A |
| 5,351,792 | 10/1994 | Cohen | 190/18 A |
| 5,524,920 | 6/1996 | Tsai | 190/18 A X |
| 5,636,733 | 6/1997 | Marchwiak | 190/18 A X |
| 5,743,363 | 4/1998 | Rekuc et al. | 190/18 A |

*Primary Examiner*—Sue A. Weaver
*Attorney, Agent, or Firm*—Flehr Hohbach Test Albritton & Herbert LLP

[57] ABSTRACT

A bag comprising a body enclosing a space and having top and bottom walls, left and right side walls and front and rear walls. The left and right side walls adjoin the bottom wall at respective left and right edges. A handle is mounted on the body. An edge guard of a plastic material is mounted on the body and extends from the bottom wall around one of the left and right edges to the respective side wall for protecting the edge from wear. The edge guard is formed with an integral foot depending from the bottom wall for supporting the body on a support surface.

19 Claims, 2 Drawing Sheets

BAG WITH INTEGRATED EDGE GUARD AND FOOT

BACKGROUND OF THE INVENTION

Field of the Invention

This invention pertains generally to bags and, more particularly, to framed fabric cases with feet.

Bags such as suitcases, briefcases and like made with outer surfaces of durable fabric material such as ballistic nylon have heretofore been provided. Zippers are typically sewn into the fabric to permit access to the internal cavities of the bag. Many of these bags have internal frames which provide support to the bag. Unfortunately, these internal frames tend to enhance wear in the fabric at the edges of the internal frame and at the edges of the bag. Damage to the zippers of the bag can also occur at the edges of the bag. The fabric and zipper wear is particularly concentrated on the lower edges of wheelable bags. There is therefore a need for a new and improved bag which overcomes these disadvantages.

OBJECTS OF THE INVENTION

In general, it is an object of the present invention to provide a bag which includes a guard for the edge of the bag.

Another object of the invention is to provide a bag of the above character in which the edge guard protects the outer fabric at the corner or edge of the bag.

Another object of the invention is to provide a bag of the above character in which the edge guard protects the outer fabric at the edge of the internal frame of the bag.

Another object of the invention is to provide a bag of the above character in which the edge guard protects a zipper extending around the edge of the bag.

Another object of the invention is to provide a bag of the above character in which the edge guard has an integral foot for supporting the bag on a support surface.

Another object of the inventions is to provide a bag of the above character in which the integrated edge guard and foot is mounted on the exterior of the bag.

Additional objects and features of the invention will appear from the following description from which the preferred embodiments are set forth in detail in conjunction with the accompanying drawings.

BRIEF SUMMARY OF THE INVENTION

In general, a bag comprising a body enclosing a space and having top and bottom walls, left and right side walls and front and rear walls is provided. The left and right side walls adjoin the bottom wall at respective left and right edges. Handle means is mounted on the body. An edge guard of a plastic material is mounted on the body and extends from the bottom wall around one of the left and right edges to the respective side wall for protecting said edge from wear. The edge guard is formed with an integral foot depending from the bottom wall for supporting the body on a support surface.

DETAILED DESCRIPTION OF THE INVENTION

Figure 1:
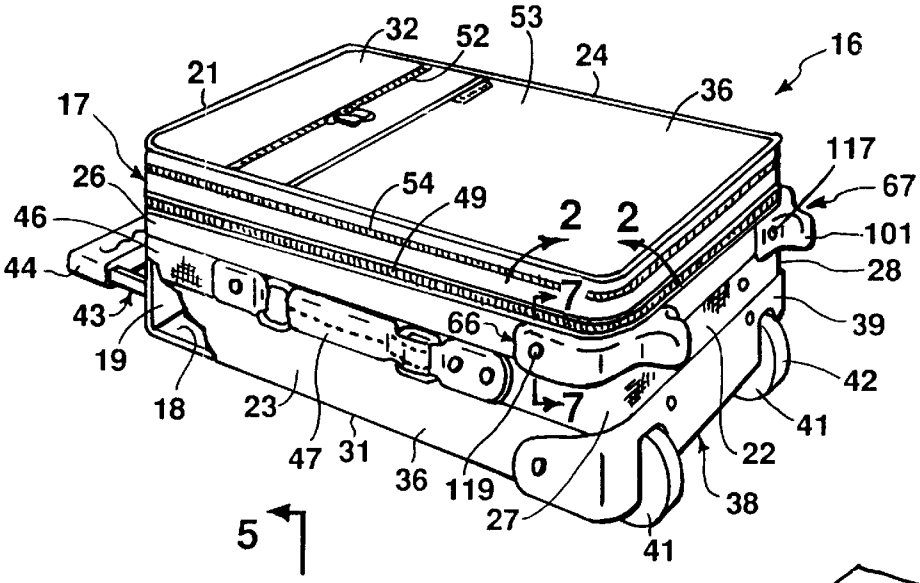
FIG. 1 is a perspective view, partially cut away, of a bag with integrated edge guard and foot of the present invention in a laid down position.

More in particular, expandable bag or upright suitcase 16 is a framed case suitable for carrying clothes and the like. Suitcase 16, as shown in FIG. 1, has a body 17 having the shape of a right parallelepiped and is formed from six generally planar walls enclosing a space or main cavity 18. Body 17 has an interior lining 19 in cavity 18 made from nylon or any other suitable material. Specifically, body 17 has substantially rigid top and bottom walls 21 and 22 and substantially rigid left and right walls 23 and 24. Walls 21–24 form the outer periphery 26 of body 17. Bottom wall 22 meets left wall 23 at rounded left edge 27 and meets right wall 24 at rounded right edge 28. Body 17 further includes a soft rear wall 31 and a soft front wall 32.

Figure 7:
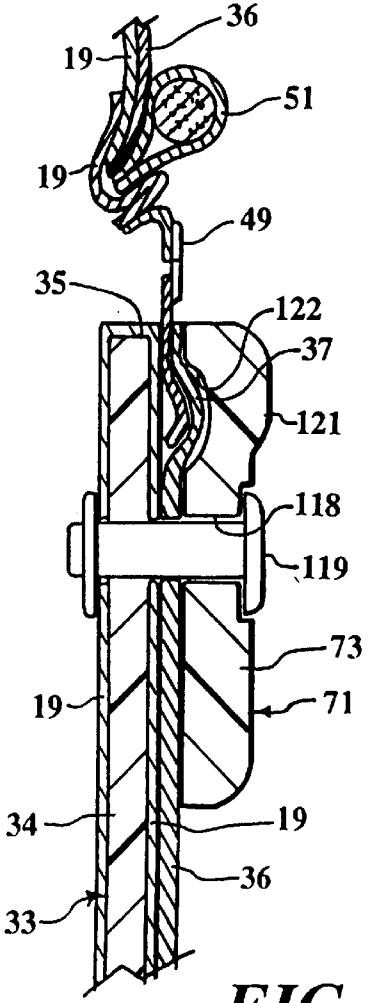
FIG. 7 is a cross-sectional view of the bag with integrated edge guard and foot of FIG. 1 taken along the line 7—7 of FIG. 1.
Figure 5:
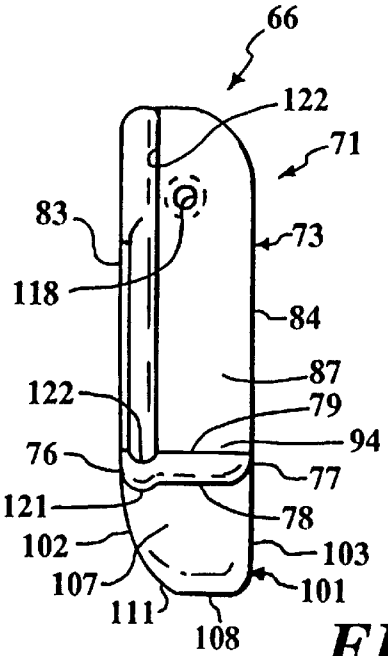
FIG. 5 is a right side elevational view of the integrated edge guard and foot of FIG. 3 taken along the line 5—5 of FIG. 3.
Figure 4:
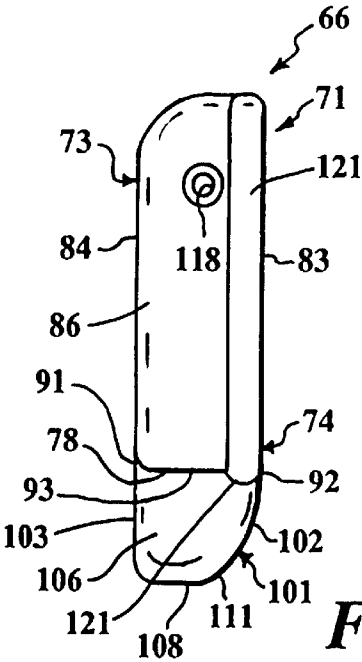
FIG. 4 is a left side elevational view of the integrated edge guard and foot of FIG. 3 taken along the line 4—4 of FIG. 3.
Figure 6:
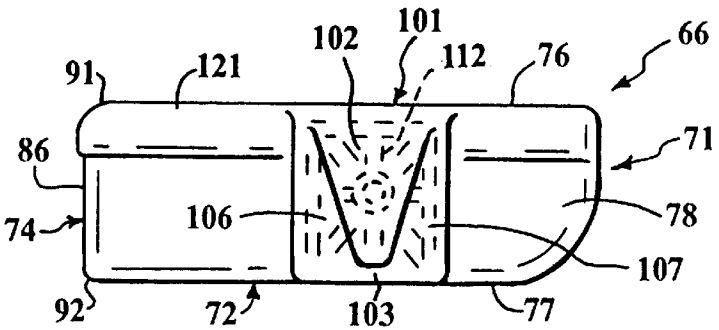
FIG. 6 is a bottom plan view of the integrated edge guard and foot of FIG. 3 taken along the line 6—6 of FIG. 3.

An internal frame member or frame 33 made from a substantially rigid material such as plastic extends around outer periphery 26 to provide support for body 17. Frame 33, a portion of which is shown in FIG. 7, has the shape of an endless rectangular member and is formed from four strip portions or planar strips 34 extending respectively through the four walls 21-24 of outer periphery 26 at right angles to each other. Frame 33 has a squared forward edge 35 and a constant thickness and a constant width. A flexible web means in the form of outer layer or cover 36 extends around body 17. Cover 36 is made from any suitable durable material such as ballistic nylon and has at least one rolled seam 37 therein.

A wheeled framework 38 is mounted to internal frame 33 at the rear of bottom wall 22 adjacent rear wall 31 (see FIG. 1). Wheeled framework 38 includes an outer piece 39 and an inner piece (not shown) disposed in main cavity or compartment 18. The outer and inner pieces are each made from any suitable material such as plastic and are secured together and to internal frame 33 by any suitable fastening means or fasteners such as rivets (not shown). Outer piece 39 has first and second opposite end portions which serve as corner and edge guards. First and second wheels 41 made from rubber or any other suitable material are included in framework 38 and are rotatably mounted in spaced apart positions along the rear lower edge of body 17 (see FIGS. 1 and 2). The outer cylindrical surface 42 of each wheel 41 is spaced from the outer surface of bottom wall 22 a distance of approximately one inch when the wheel 41 is at the lowest point in its rotation. Wheeled framework 38 includes a handle assembly 43 which extends up the outside of rear wall 31. Handle assembly 43 has a handle means or handle 44 which is extendible upwardly from top wall 21 in a direction parallel to the plane of rear wall 31.

Figure 2:
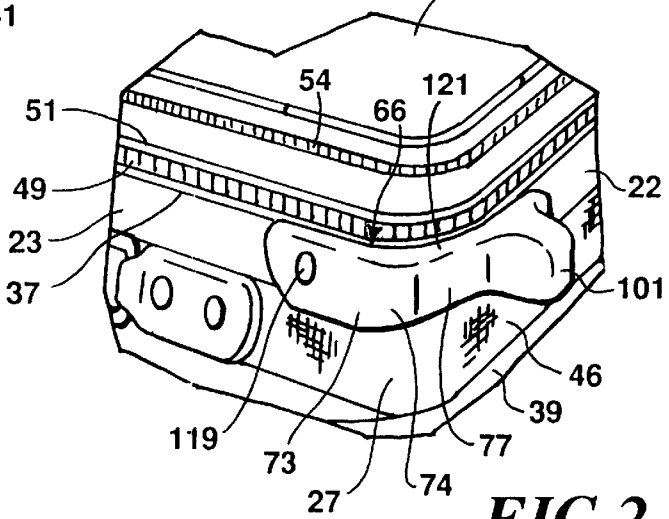
FIG. 2 is an enlarged view of a portion of FIG. 1 taken along the lines 2—2 of FIG. 1.
Figure 3:
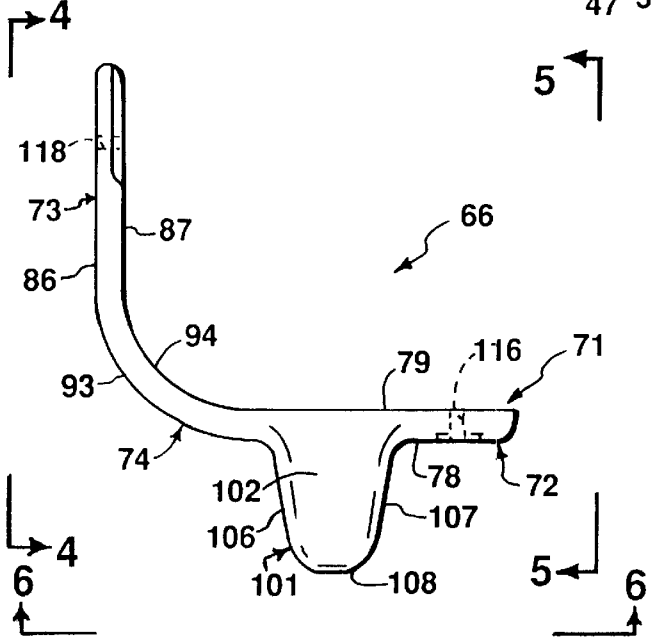
FIG. 3 is a front elevational view of the integrated edge guard and foot of the present expansion shown in FIG. 2.

A strengthening strap 46 made from any suitable material such as nylon webbing, ballistic nylon or leather extends around and is secured to cover 36 on outer periphery 26 by any suitable means such as stitching (see FIGS. 1 and 2). A first handle means or handle 47 is secured to strengthening strap 46 in the middle of left wall 23 to permit carrying of suitcase 16 on its side. A second similar handle strap (not shown) is secured to strap 46 in the middle of top wall 21 to permit carrying of suitcase 16 in an upright position.

A main zipper 49 extends around a portion of outer periphery 26 on top and bottom walls 21 and 22 and left wall 23 (see FIGS. 2 and 7). The zipper extends around left and right rounded edges 27 and 28. Cover 36 includes piping 51 which extends around outer periphery 26 adjacent and forward of main zipper 49. Zipper 49 is a size ten conventional zipper and allows front wall 32 to pivot from right wall 24 so as to open and thus permit access to main cavity 18. A secondary zipper 52 extends across the outside of front wall 32 to permit access to a front pocket 53 provided in the front wall 32. A third zipper 54 extends around outer periphery 26 parallel to and forward of main zipper 49 for accessing a second compartment in body 17.

Suitcase 16 includes protective means for protecting cover 36 at left and right lower edges 27 and 28 from wear and tear during use of suitcase 16 (see FIGS. 1 and 2). The protective means includes left and right edge guard members or edge guards 66 and 67 mounted on internal frame 33 at respective left and right edges 27 and 28. Left and right edge guards 66 and 67 are substantially identical, being mirror images of each other, and are each formed from a body 71 made from any suitable material such as plastic. More specifically, body 71 can be injection molded from plastic. Each of the bodies 71 has a bottom portion 72, a side portion 73 and an arcuate corner portion 74 joining together the bottom and side portions 72 and 73 (see FIGS. 3–6). Bottom portion 72 is formed with first and second opposite parallel sides in the form of front side 76 and rear side 77 and first and second spaced-apart surfaces 78 and 79 extending between front and rear sides 76 and 77. First or outer or lower surface 78 is generally planar and extends in a plane parallel to the plane of planar second or inner or upper surface 79. Side portion 73 is similarly formed with parallel front and rear sides 83 and 84 and first and second spaced-apart surfaces 86 and 87 extending between sides 83 and 84. First or outer surface 86 is substantially planar and extends in a plane generally parallel to the plane of planar second or inner surface 87. Arcuate portion 74 has a front side 91 which adjoins front sides 76 and 83 and rear side 92 which adjoins rear sides 77 and 84. Front sides 76, 83 and 91 extend in a plane parallel to the plane of rear sides 77, 84 and 92 and perpendicular to the walls of outer periphery 26. Arcuate portion 74 further includes an arcuate outer surface 93 which respectively adjoins outer surfaces 78 and 86 at its opposite ends and an arcuate inner surface 94 which respectively adjoins inner surfaces 79 and 87 at its opposite ends.

Each of bodies 71 is formed with an integral foot 101 depending from bottom portion 72 thereof (see FIGS. 3–6). The foot 101 is formed from a front surface 102 and a rear planar surface 103 and left and right generally planar surfaces 106 and 107. Foot 101 is further formed from a bottom planar surface 108 extending generally parallel to outer surface 78 of bottom portion 72. Front surface 102 of the foot 101 arcs downwardly and rearwardly from the plane of sides 76, 83 and 91 to bottom surface 108. Rear surface 103 of the foot and rear sides 77, 84 and 92 lie in a plane extending perpendicular to bottom wall 22. Left and right surfaces 106 and 107 taper inwardly toward each other as they extend from the outer surface 78 of bottom portion 72 to bottom surface 108 of the foot 101. The surfaces 102, 103, 106, 107 and 108 adjoin each other at rounded edges. Bottom surface 108 adjoins front surface 102 at a rounded front edge 111 which has a radius significantly greater than the radii of the other edges forming foot 101. Foot 101 is hollow to reduce the material necessary to form the foot and is provided with a plurality of internal walls 112 to provide structural support to the foot.

Fastening means is carried by body 71 and internal frame 33 for fastening left and right edge guards 66 and 67 to suitcase body 17. A first bore 116 extends perpendicularly through outer and inner surfaces 78 and 79 of each bottom portion 71 for receiving a first fastening means or fastener in the form of first rivet 117. The flat head rivet 117 extends through bottom portion 72 and frame 33. A second bore 118 extends perpendicularly through outer and inner surfaces 86 and 87 of each side portion 73 for receiving a similar second rivet 119, which extends through the side portion 73 and internal frame 33. As such, bottom portion 72 of each of the left and right edge guards 66 and 67 is mounted on bottom wall 22 of the suitcase 16 so that arcuate portions 74 extend around respective left or right edge 27 or 28 to respective left or right wall 23 or 24 of the suitcase 16.

Each of the left and right edge guards 66 and 67 is mounted to suitcase body 17 so that the front sides 76, 83 and 81 of the edge guards are adjacent main zipper 49 (see FIG. 2). The left and right edge guards 66 and 67 are each provided with a rib 121 which extends longitudinally along outer surfaces 78, 93 and 86 adjacent front sides 76, 91 and 83 (see FIGS. 2 and 4–7). The upstanding rib 121 has a cross-section which is arcuate in conformation so as to have a generally smooth outer surface. Edge guards 66 and 67 rest on cover 36 of suitcase 16. At least one rolled seam 37 extends around outer periphery 26 and thus under the edge guards. Body 71 of each edge guard is provided with a continuous groove 122 which extends longitudinally along inner surfaces 79, 94 and 87 in the body 71 for receiving the rolled seam 37. The edge guards thus mount flush on cover 36.

In operation and use, left and right edge guards 66 and 67 have an outer surface, which includes outer surfaces 78, 93 and 86 and the outer surface of rib 121, that is spaced outwardly from cover 36. The relatively rigid and durable material of the edge guards 66 and 67 serves to protect left and right edges 27 and 28, and particularly the material of cover 36, from wear and tear during use of suitcase 16 by first engaging objects encountered by suitcase 16. The placement of left and right edge guards 66 and 67 over forward edge 35 of internal frame 33 also protects the portion of cover 36 beneath the edge guards and overlying forward edges 35. The edge guards 66 and 67 are disposed adjacent main zipper 49 and thus inhibit objects engaged by suitcase 16 from contacting and possibly damaging zipper 49. Outer rib 121, which is disposed adjacent the main zipper 49 and extends longitudinally along the zipper around the lower edges of body 17, contributes to the protection of the zipper 49. Rib 121 causes the body 71 to extend further outwardly from cover 36, thus inhibiting contact with the nearby zipper 49. Edge guards 66 and 67 can be used for protecting any size zipper and are particularly useful for protecting zippers with large profiles.

Foot 101 depends from bottom wall 22 for supporting suitcase 16 on a support surface. Bottom surface 108 of each foot 101 is spaced below bottom wall 22 a distance approximately equal to the distance which the outer cylindrical surface 42 of each wheel 41 is spaced below the bottom wall 22. Thus, the left and right wheels 41 and left and right feet 101 provide four stable supports for supporting the suitcase 16 in a level position on the support surface. Front edge 111 of each foot 101 is rounded to reduce wear of the foot and to facilitate a smooth transition when moving suitcase 16 toward or away from its generally upright position.

The integrated foot and edge guards 66 and 67 have an aesthetically pleasing appearance. The angular surfaces between the faces or surfaces or body 71 are not severe. Instead, these angular surfaces are radiused so as to provide a smooth transition between adjoining faces of the body 71. The angular surfaces also reduce stress concentrations or risers where the faces of the body 71 adjoin.

From the foregoing, it can be seen that a new bag which includes a guard for the edge of the bag has been provided. The edge guard protects the outer fabric at the corner or edge of the bag and at the edge of the internal frame of the bag. The edge guard can also protect a zipper extending around the edge of the bag. An integral foot for supporting the bag on a support surface is included in the edge guard. The integrated edge guard and foot is mounted on the exterior of the bag.

What is claimed is:

1. A bag comprising a body enclosing a space, the body having top and bottom walls, left and right side walls and front and rear walls, the left and right side walls adjoining the bottom wall at respective left and right edges, a handle mounted on the body, a left edge guard of a plastic material mounted on the body and extending from the bottom wall around the left edge to the left side wall for protecting the left edge from wear, a right edge guard of a plastic material mounted on the body and extending from the bottom wall around the right edge to the right side wall for protecting the right edge from wear, the body having a zipper extending from the bottom wall around at least one of the left and right edges to he respective side wall, the respective edge guard being mounted on the body adjacent the zipper protecting the zipper from damage, each of the left and right edge guards being formed with an integral foot depending from the bottom wall for supporting the body on a support surface.

2. A bag as in claim 1 wherein each of the left and right edge guards extends outwardly from the body so as to engage objects prior to the respective edge.

3. A bag as in claim 1 wherein each of the left and right edge guards has a bottom portion mounted on the bottom wall and a side portion mounted on the respective side wall, an arcuate portion adjoining the bottom and side portions and extending around the respective edge.

4. A bag as in claim 3 wherein the body has an outer layer made from a flexible web material, the outer layer having a rolled seam and the bottom and side portions and the arcuate portion of the edge guard being provided with a continuous groove therein for receiving the rolled seam and facilitating flush mounting of the edge guard to the body.

5. A bag as in claim 3 wherein each of the bottom and side portions has parallel front and rear sides and outer and inner planar surfaces extending between the front and rear sides.

6. A bag as in claim 5 wherein the front sides of the bottom and side portions extend in a first plane and the rear sides of the bottom and side portions extend in a second plane parallel to the first plane.

7. A bag as in claim 5 wherein the outer and inner planar surfaces of the bottom portion are parallel and the outer and inner planar surfaces of the side portion are parallel.

8. A bag as in claim 5 wherein the foot has opposite front and rear surfaces, the front surface extending from the front side of the bottom portion and the rear surface and the rear side of the bottom portion extending in a plane.

9. A bag as in claim 8 wherein the foot has left and right surfaces extending toward each other as they extend from the outer surface of the bottom portion.

10. A bag as in claim 1 wherein the left and right edge guards are separate from each other.

11. A bag comprising a framed case enclosing a space and having top and bottom walls, left and right side walls and front and rear walls, the left and right side walls adjoining the bottom wall at respective left and right rounded edges, a handle mounted on the framed case, a zipper extending from the bottom wall around one of the left and right rounded edges, an edge guard of a plastic material mounted on the framed case and extending from the bottom wall around said edge to the respective side wall for protecting said edge from wear, the edge guard being mounted on the framed case adjacent the zipper and having an outer surface spaced outwardly from the zipper for protecting the zipper from damage.

12. A bag as in claim 11 wherein the zipper is a size ten zipper.

13. A bag as in claim 11 wherein the edge guard has a bottom portion mounted on the bottom wall and a side portion mounted on the side wall, an arcuate portion adjoining the bottom and side portions and extending around said edge, the bottom and side portions having a side adjacent the zipper and extending in a plane.

14. A bag as in claim 11 wherein the zipper extends from the bottom wall around each of the left and right rounded edges and wherein the edge guard extends around the left rounded edge, additional edge guard of a plastic material being mounted on the framed case and extending from the bottom wall around the right rounded edge adjacent the zipper and having an outer surface spaced outwardly from the zipper for protecting the zipper from damage.

15. A bag comprising a body enclosing a space, the body having top and bottom walls, left and right side walls and front and rear walls, the left and right side walls adjoining the bottom wall at respective left and right rounded edges, a wheeled framework and a handle mounted on the body, a zipper extending from the bottom wall around take left and right edges to the left and right side walls, a left edge guard of a plastic material mounted on the body and extending from the bottom wall around the left edge to the left side wall for protecting the left edge from wear, a right edge guard of a plastic material mounted on the body and extending from the bottom wall around the right edge to the right side wall for protecting the right edge from wear, the left and right edge guards being mounted on the body adjacent the zipper for protecting the zipper from damage.

16. A bag as in claim 15 wherein the left and right edge guards are each formed with an integral foot depending from the bottom wall supporting the body on a support surface.

17. A bag as in claim 15 wherein the left and right edge guards each have an outer surface spaced outwardly from the zipper.

18. A bag as in claim 15 wherein the left and right edge guards are separate from each other.

19. A bag as in claim 15 wherein the rear wall adjoins the bottom wall at a rear edge and wherein the wheeled framework includes first and second spaced-apart wheels rotatable about an axis extending parallel to the rear edge.

* * * * *